US005347735A

United States Patent [19]

Pratt

[11] Patent Number: 5,347,735

[45] Date of Patent: Sep. 20, 1994

[54] PRESENTATION AID HAVING MULTIPLE ILLUMINATION SOURCES

[76] Inventor: Howard A. Pratt, 8390 NW. Copeland St., Portland, Oreg. 97229

[21] Appl. No.: 971,941

[22] Filed: Nov. 5, 1992

[51] Int. Cl.[5] ..... G09F 11/18

[52] U.S. Cl. ..... 40/518; 40/573

[58] Field of Search ..... 40/541, 564, 573, 117, 40/347, 518, 23, 29; 362/30, 236, 237, 812

[56] References Cited

U.S. PATENT DOCUMENTS

| | | | |
|---|---|---|---|
| 1,706,550 | 3/1929 | Stader . | |
| 2,211,571 | 8/1940 | Jonap | 40/132 |
| 2,600,816 | 6/1952 | Tuttle et al. | 40/133.1 |
| 3,131,496 | 5/1964 | Schropp | 40/130 |
| 3,293,782 | 12/1966 | Drexler | 40/31 |
| 3,364,604 | 1/1968 | Donaldson et al. | 40/31 |
| 3,451,152 | 6/1969 | White | 40/518 |
| 3,496,664 | 2/1970 | Gaffney et al. | 40/518 |
| 3,510,973 | 5/1960 | Mazzocco, Sr. | 40/31 |
| 3,584,401 | 6/1971 | Cryer et al. | 40/573 X |
| 3,688,425 | 9/1972 | Hobbs | 40/573 |
| 3,745,678 | 7/1973 | Thomassen | 40/106.52 |
| 3,796,484 | 3/1974 | Forster, Jr. | 353/25 |
| 4,639,725 | 1/1987 | Franke | 40/573 X |
| 4,773,176 | 9/1988 | Grehan | 40/471 |
| 4,965,947 | 10/1990 | Zanetti | 40/471 |
| 4,995,183 | 2/1991 | Aiken, Sr. | 40/518 |

*Primary Examiner*—Clifford D. Crowder
*Assistant Examiner*—Paul C. Lewis
*Attorney, Agent, or Firm*—Smith-Hill and Bedell

[57] ABSTRACT

A presentation aid employs a translucent panel having a milky appearance and which is back lit by a number of illumination sources, each source illuminating a specific portion of the panel. Baffles separate adjacent illumination sources so that light from one illumination source does not substantially illuminate a portion of the panel associated with other illumination sources. A sheet of information carrying material passes between the illumination sources and the back of the panel, such that the information on the sheet is not visible at the front face of the panel unless an illumination source is activated behind the information. The various illumination sources may be selectively activated to provide controlled viewing of the information. Rollers wind and unwind the sheet of information carrying material in response to operator command to allow changing of the information.

27 Claims, 3 Drawing Sheets

PRESENTATION AID HAVING MULTIPLE ILLUMINATION SOURCES

BACKGROUND OF THE INVENTION

This invention relates to a presentation aid and more particularly to a visual presentation aid that enables the presenter to prevent an audience from anticipating material in advance of the presenter's chosen timing.

An oral presentation is often coupled with a visual presentation employing a multi-page easel pad. Typically, each page of the easel pad carries five or six written items, and as that page is revealed, by turning over the previous page, the audience sees all items simultaneously. This encourages the audience to anticipate the presenter's sequence, and distracts attention from the presenter. Further, turning the pages of the easel pad can be awkward or difficult, particularly for a presenter who is not tall, and if a page is torn it is advisable to prepare a complete new set of pages in order to avoid the unfavorable impression of the torn page.

Despite these potential pitfalls, the easel pad type of visual presentation aid is still preferable over, for example, an overhead projector, because the presenter stands close to the easel pad, turning the pages and pointing to the information, so that the presenter and the information are perceived as a unit and the audience's attention is always directed to the presenter and the information together, rather taken being alternately directed to the information displayed on a projection screen and the presenter.

SUMMARY OF THE INVENTION

A presentation aid according to the present invention includes a translucent display panel having a front surface and a back surface. An information carrying sheet is disposed adjacent the back surface of the translucent display panel with information to be presented disposed on the sheet. A means is provided for selectively illuminating a first portion of the information carrying sheet while preventing illumination from reaching a second portion of the information carrying sheet, to enable viewing of information carried on the first portion from the front surface of the translucent display panel while preventing viewing of information carried on the second portion.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
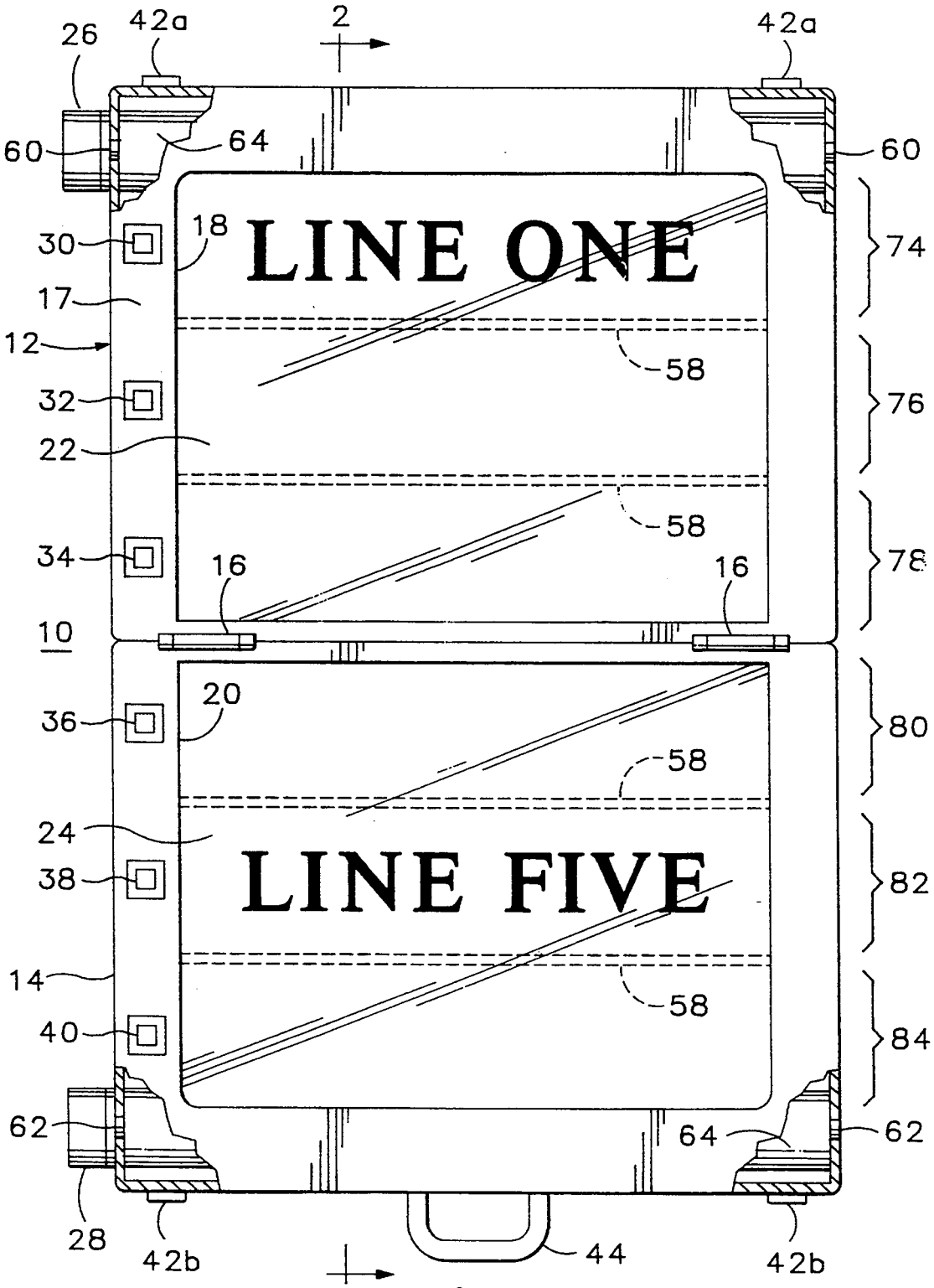
FIG. 1 is a front view of a presentation aid.
Figure 2:
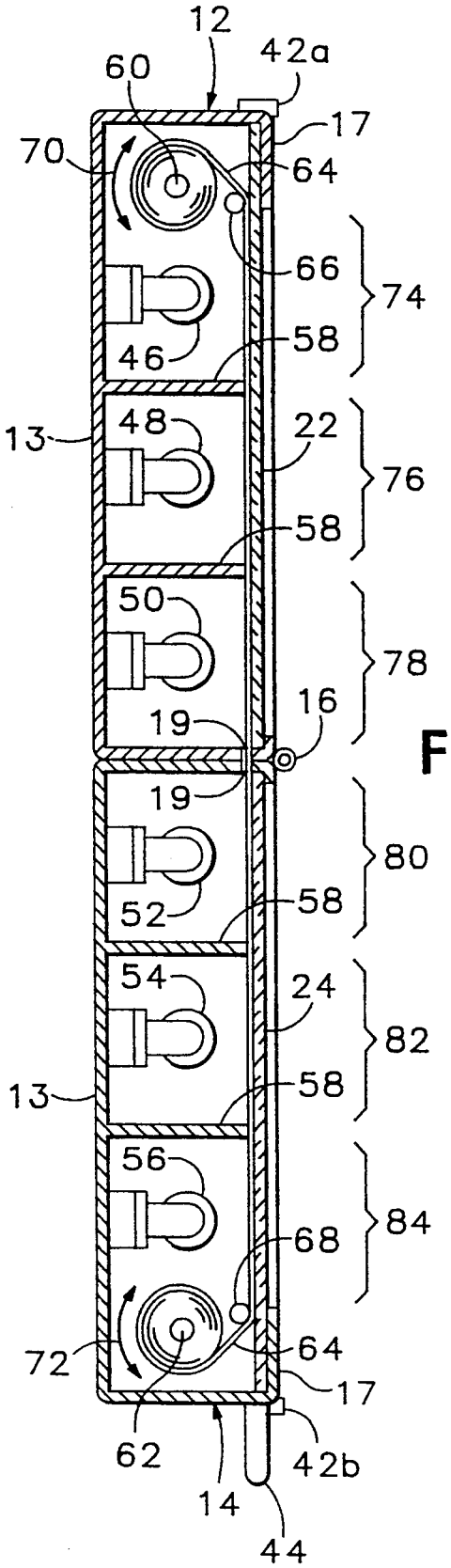
FIG. 2 is a section view of the presentation aid of FIG. 1 along line 2—2.
Figure 3:
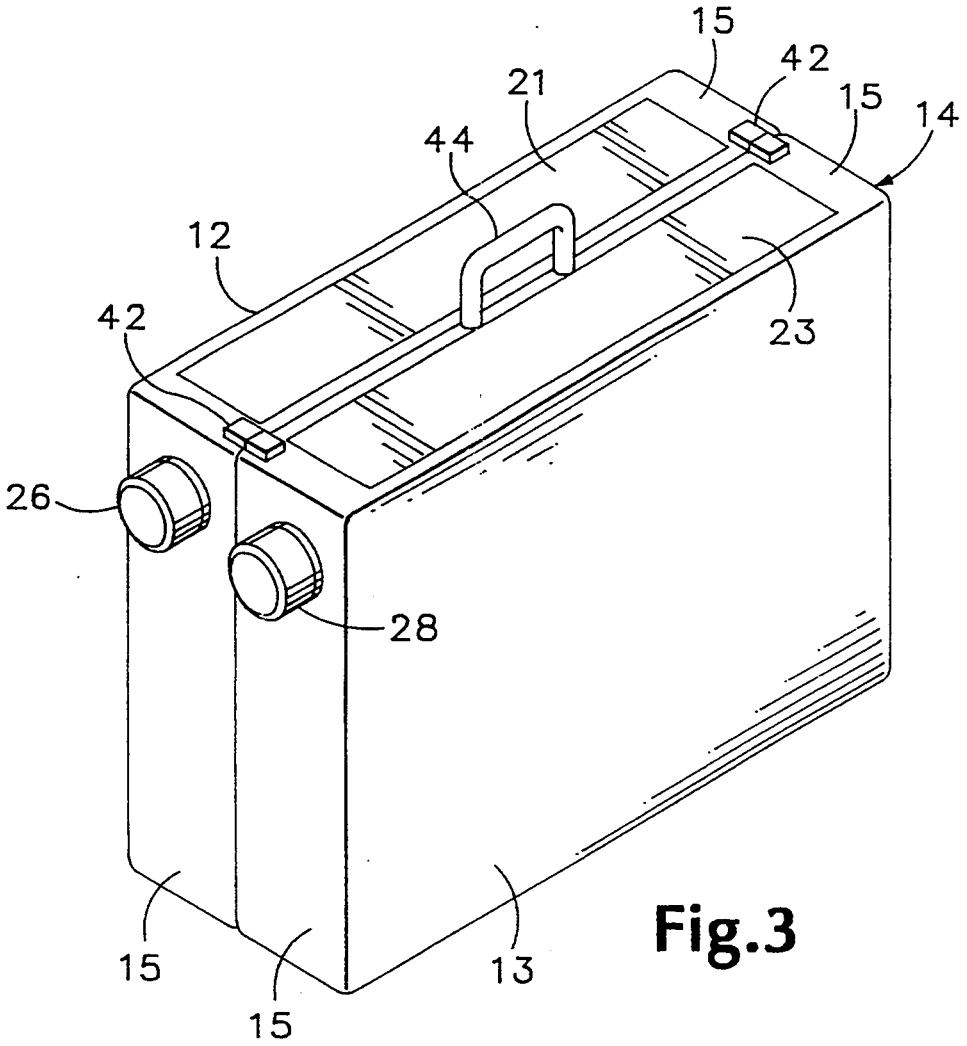
FIG. 3 is a perspective view of the presentation aid of FIG. 1 in a folded position.

FIG. 1 illustrates a front view of a presentation aid 10 designed for use by a speaker when presenting information to a group, for example in a court room, a classroom or other situation where the speaker presents visual information in conjunction with oral information. The presentation aid includes a case comprising a first case portion 12 and a second case portion 14. Hinges 16 (two in the illustrated embodiment) couple the first and second portions such that the presentation aid is roughly bi-laterally symmetrical along the hinge joints. Referring to FIGS. 1–3 together, each case portion comprises a back 13, four side walls 15 and a flange 17 that extends inwardly from the side walls and defines a 'window' that is of relatively large size with respect to the overall size of the case portions. Translucent panels 22 and 24 fit within and completely cover open portions 18 and 20 to provide viewing surfaces on the front faces thereof, held in place for example, by slots within the case portions (not shown). Panels 22 and 24 are suitably milky in appearance, i.e. having a diluted white color, and reflect light more strongly than they transmit light such that items adjacent the back surfaces of the panels are not readily perceivable from the front surfaces of the panels, and suitably comprise Rohm and Haas acrylic plastic, part number 2447. A pair of latches 42 comprise mating latch members **42*a* and 42*b* and are mounted at extreme edges of case portions 12 and 14 respectively. A carrying handle 44, which provides a balanced load when carrying the presentation aide, is attached to case portion 14** in the illustrated embodiment.

Referring to FIG. 1 in conjunction with FIG. 2, a section view of the presentation aid of FIG. 1 along line 2—2, internal components of the presentation aid and their relation to the externally visible components will be better understood. It may be observed that case portions 12 and 14 are substantially hollow, so as to provide internal cavities. A slot 19 is provided along the adjacent side walls 15 of both case portion 12 and case portion 14, parallel to the hinge joint axis. A series of illumination sources 46, 48, 50, 52, 54 and 56, which may be standard fluorescent tubes, are placed within the cavities of the case portions so as to direct light towards the back faces of panels 22 and 24, sources 46, 48 and 50 being placed within case portion 12 and sources 52, 54, and 56 within case portion 14. Baffle members 58 are mounted within the case portions between adjacent illumination sources while the side walls of case portions 12 and 14 serve as baffles between illumination source 50 of the first case portion and illumination source 52 of the second case portion. Each baffle serves to shield the portion of the panel 22 or 24 at one side of the baffle from the illumination source at the other side of the baffle. Placed along one side of case portion 12, are a series of evenly spaced control switches 30, 32 and 34. A series of control switches 36, 38 and 40 are also mounted in similar arrangement along a corresponding edge of case portion 14. Switches 30, 32, 34, 36, 38 and 40 control whether illumination sources 46, 48, 50, 52, 54 and 56 respectively are lighted.

Roller handles 26 and 28 are mounted at one side of the presentation aid, handle 26 being mounted near the outer extreme edge (relative to hinges 16) of case portion 12 and handle 28 being mounted near the outer extreme edge of case portion 14. Rollers 60 and 62, positioned within case portions 12 and 14 at respective distal ends thereof, are in engaging relation with roller handles 26 and 28, as illustrated in partially broken away portions of FIG. 1, and rollably receive a flexible, transparent information carrying sheet 64, suitably comprising a transparent plastic film sheet. First guide rod 66 (FIG. 2) is mounted between roller 60 and translucent panel 22 while second guide rod 68 is mounted between roller 62 and translucent panel 24. Doors 21 and 23, visible in FIG. 3, are provided at opposite ends of case portions 12 and 14 respectively, adjacent rollers 60 and 62.

Sheet 64, which is continuous in nature, extends from roller 60, over first guide rod 66, adjacent the back face of translucent panel 22, through slot 19, adjacent the back face of panel 24, and over second guide rod 68 to roller 62. Each roller is adapted to rotate bi-directionally, indicated by arrows 70 and 72, so as to wind and unwind sheet 64 in conjunction with the direction of rotation of the roller handles.

In use, visual information to be presented is provided on sheet 64, for example, through use of "dry erase" type markers. Doors 21 and 23 allow sheet 64 to be withdrawn and replaced, so that information may be placed on the sheet while the sheet is outside of the presentation aid. With the sheet removed from the presentation aid, the presenter unrolls the sheet and writes information thereon. Then, the sheet is wound onto roller 60. The sheet is then fed along slot 19 and is threaded onto roller 62. Access to roller 62 for threading the sheet is gained via door 23. The doors are then shut, roller handle 28 is rotated until the first information to be presented is positioned adjacent the panels and the presentation aid is transported to the site where the presentation is to take place.

During presentation, the sheet is rolled from roller 60 onto roller 62, by rotation of roller handle 28. The plastic sheet is held against the back face of the translucent panels by guides 66 and 68 and baffles 58. Due to the light transmission characteristics of the panels and the case configuration, the viewer does not receive light from inside the case portions and information on sheet 64 is not visible from the front of the panels until illumination is provided from the back of the plastic sheet. Therefore, the presenter is able to control when the particular items of the visual material become visible to the audience by control of the illumination sources. This control arises from the cooperation of the translucent panels, the plastic sheet, the baffle members and the switch controlled application of back lighting behind the panel and plastic sheet. Thus, referring to FIG. 1, it may be observed that distinct viewing areas 74, 76, 78, 80, 82 and 84 are provided. In those areas where the corresponding illumination sources are activated, the material on sheet 64 will be visible. However, since light from one illumination source is prevented from reaching any other viewing area by the baffle members, only the material in the viewing area corresponding to that one illumination source will be visible. As an example, in FIG. 1, the illumination sources 46 and 54 are lighted, resulting in the information on plastic sheet 64 being visible in viewing area 74 ("LINE ONE") and viewing area 82 ("LINE FIVE"). Because illumination sources 48, 50, 52 and 56 have not been activated, the information on sheet 64 is not visible at areas 76, 78, 80 and 84. As the presenter advances through the presentation, by activation of the various illumination sources, the presenter is able to bring the written material into view of the audience in time with other portions of the presentation. Therefore, the presenter is able to control the presentation so the audience does not read ahead or consider points other than those which the presenter wishes to stress. When the presenter is finished with one set of information, the illumination sources are turned off and the rollers may be advanced to bring another set into relation with the panels, by rotating roller handle 28. This operation corresponds to turning a page on an easel. Alternatively, the sheet can be incrementally advanced, for example, to bring one new point into view at a time. Once the presentation is completed, the sheet is rewound onto roller 60 by rotation of roller handle 26.

As mentioned hereinabove, the panels 22 and 24 fit within slots and may thereby slide so as to be removable when the doors 21 or 23 are open. Therefore, access to the sheet is allowed while the sheet is installed in the presentation aid, for editing existing information or placing new information on the sheet without requiring the removal of the sheet from the presentation aid.

The illumination sources may be powered by any suitable supply, for example, by connection to AC power mains or by battery. In the illustrated embodiment, the illumination sources comprise fluorescent light bulbs, selectively connected to external AC power as governed by the switches 30–40.

FIG. 3 illustrates the presentation aid 10 of FIG. 1 in a folded configuration. As mentioned in connection with FIGS. 1 and 2, first and second case portions 12 and 14 are joined via hinges 16 (not visible in FIG. 3). The hinges enable the two case portions to be folded to place the translucent panels 22 and 24 adjacent one another. Once so folded, mating latch members 42*a* and 42*b* are fastened and the entire package may be carried via handle 44. The ability to fold the presentation aid presents a more easily transported package, while providing protection against damage or unsightly marring of the panels or other portions of the presentation aid to which the attention of an audience will be directed.

Figure 4:
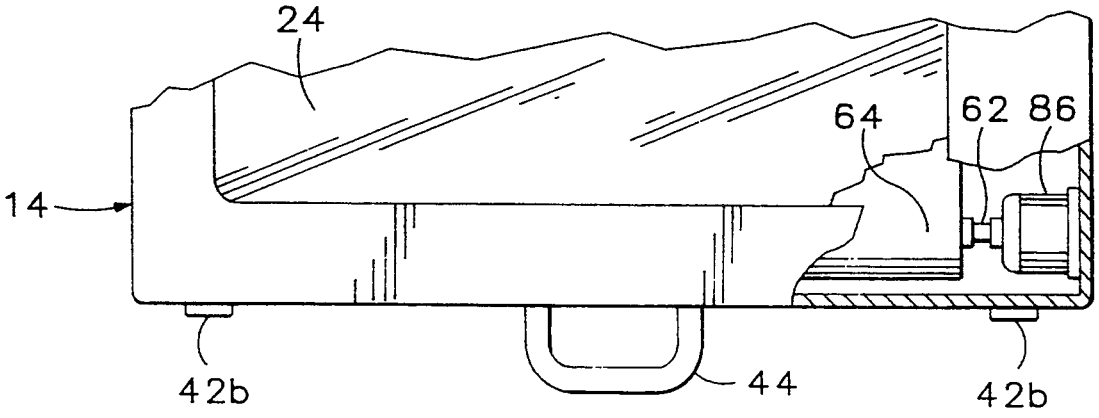
FIG. 4 is a partial cut-away view of an embodiment of the presentation aid employing a motor.

FIG. 4 is a partial cut-away view of an embodiment of the presentation aid employing a motor for driving the rollers. Motor 86, which may comprise a stepper motor for example, is mounted within case portion 14, in driving relation with roller 62. Rotation of the motor then governs when roller 62 reels up the sheet 64 from roller 60, which freewheels during rotation of the motor. After presentation, the sheet is rewound onto roller 60 by rotation of handle 26. An optional motor (not shown) may be attached to roller 60 within case portion 12 to enable motorized rewinding. Motor rotation may be controlled either by a control mounted on the case or by remote control. Motor 86 may be adjusted to provide a controlled amount of movement of sheet 64 to incrementally move the sheet through the viewing area such that the sheet advances in a known manner in relation to viewing areas 74–84.

The presentation aid enables controlled viewing of the presenter's points, without the need to flip pages of an easel pad and the accompanying difficulties and potential for tearing a page of the pad. The aid also provides greater control of the presentation material as would be available with overhead projection systems, while enabling the presenter to remain close to the material by operation of the individual switches adjacent the display areas of the presentation aid, so that the audience's attention may be focused on the presenter and the material at the same time.

It will be appreciated that the present invention is not restricted to the particular embodiment that has been described, and that variations may be made therein without departing from the scope of the invention as defined in the appended claims and equivalents thereof.

I claim:

1. A presentation aid for presenting information to an audience comprising:

a translucent display panel having a front surface and a back surface;

an information carrying member disposed adjacent the back surface of said translucent display panel wherein information is carried on said information carrying member;

an illumination source for illuminating a first portion of said information carrying member; said illumination source being positioned so that the information carrying member is between the illumination source and the translucent display panel; and a shielding means for preventing illumination from said illumination source from reaching a second portion of said information carrying member, whereby information carried on said first portion can be viewed from the front of said translucent display panel while not affecting viewing of information carried on said second portion.

2. The presentation aid according to claim 1 wherein said information carrying member comprises a flexible material sheet.

3. The presentation aid according to claim 1 further comprising a second illumination source for illuminating said second portion of said information carrying member, said second illumination source being positioned so that the information carrying member is between the second illumination source and the translucent display panel and said shielding means preventing illumination from said second illumination source from reaching said first portion of said information carrying member to enable viewing of information carried on said second portion from the front of said translucent display panel while not affecting viewing of information carried on said first portion.

4. The presentation aid according to claim 3 wherein said first illumination source is disposed near the first portion of said information carrying member, said second illumination source is disposed near the second portion of said information carrying member, and said shielding means is placed along a border between the first and second portions of said information carrying member for substantially preventing light from one of said first and second illumination sources from reaching the portion of said information carrying member associated with the other of said first and second illumination sources.

5. The presentation aid according to claim 4 further comprising means for independently controlling the illumination of said first and said second illumination sources.

6. The presentation aid according to claim 5 wherein said means for independently controlling the illumination of said first and said second illumination sources comprises a first switch and a second switch.

7. The presentation aid according to claim 1 wherein said translucent display panel has a diluted white appearance.

8. The presentation aid according to claim 1, wherein the translucent display panel has a display portion, the information carrying member is movable selectively to place either said first portion or said second portion against the display portion of the translucent display panel, and the shielding means allows illumination from said illumination source to reach said display portion of the translucent display panel while preventing illumination from said illumination source from reaching other portions of the translucent display panel, so that in a first position of the information carrying member information carried on said first portion can be viewed through the display portion of the translucent display panel from in front of said translucent display panel while not affecting viewing of information carried on said second portion, and in a second position of the information carrying member information carried on said second portion can be viewed through the display portion of the translucent display panel from in front of said translucent display panel while not affecting viewing of information carried on said first portion.

9. The presentation aid according to claim 1, wherein the translucent display panel has a first display portion and a second display portion, the information carrying member has a first portion and a second portion, and the presentation aid further comprises a second illumination source positioned so that the information carrying member is between the second illumination source and the translucent display panel, and the shielding means allows illumination from the first illumination source to reach said first display portion of the translucent display panel while preventing illumination from the first illumination source from reaching said second display portion of the translucent display panel, and allows illumination from the second illumination source to reach said second display portion of the translucent display panel while preventing illumination from the second illumination source from reaching said first display portion of the translucent display panel, whereby information carried on said first portion of the information carrying member can be viewed through said first display portion while not affecting viewing of information carried on said second portion of the information carrying member, and information carried on said second portion of the information carrying member can be viewed through said second display portion while not affecting viewing of information carried on said first portion of the information carrying member.

10. The presentation aid according to claim 9, wherein the information carrying member is movable selectively to place either said first portion or said second portion of the information carrying member against the first display portion of the translucent display panel, and the information carrying member has a third portion that is against said second display portion of the information display panel when said second portion of the information carrying member is against said first display portion of the translucent display panel.

11. The presentation aid according to claim 1, wherein the information carrying member is an intermediate segment of an elongate flexible material sheet, said flexible material sheet having first and second opposite end segments with the intermediate segment therebetween, and wherein the presentation aid further comprises a first roller means having said first end segment wound thereon, a second roller means having said second end segment wound thereon, a means for rotating at least one of the first and second roller means in a sense for winding the flexible material sheet from the first roller means onto the second roller means, and a second illumination source for illuminating a second portion of said information carrying member, said second illumination source being between the first illumination source and the second roller means, and wherein the shielding means comprises a baffle that is disposed between the first and second illumination sources and extends transversely of a direction from the first roller means toward the second roller means.

12. The presentation aid according to claim 1, wherein the illumination source is a flourescent tube.

13. A method for presenting information to an audience comprising the steps of:

providing a translucent display panel having a front surface and a back surface;

placing an information carrying member adjacent the back surface of said translucent display panel wherein information is carried on said information carrying member; and illuminating a first portion of said information carrying member from the side of said information carrying member opposite the translucent display panel while preventing illumination from reaching a second portion of said information carrying member to enable viewing of information carried on said first portion from the front of said translucent display panel while not affecting viewing of information carried on said second portion.

14. The method according to claim 9 wherein said step of illuminating a first portion of said information carrying member while preventing illumination from reaching a second portion of said information carrying member comprises:

providing at least one illumination source disposed adjacent the side of said information carrying member opposite the translucent display panel; and providing a light blocking member along a border between the first and second portions of said information carrying member.

15. The method according to claim 9 further comprising illuminating said second portion of said information carrying member from the side of said information carrying member opposite the translucent display panel while preventing illumination from reaching said first portion of said information carrying member to enable viewing of information carried on said second portion from the front of said translucent display panel while not affecting viewing of information carried on said first portion.

16. The method according to claim 15 wherein said step of illuminating said first portion of said information carrying member while preventing illumination from reaching said second portion and said step of illuminating said second portion of said information carrying member while preventing illumination from reaching said first portion comprise:

providing a first illumination source disposed near the first portion of said information carrying member adjacent the side of said information carrying member opposite the translucent display panel;

providing a second illumination source disposed near the second portion of said information carrying member adjacent the side of said information carrying member opposite the translucent display panel; and providing a light blocking member along a border between the first and second portions of said information carrying member for substantially preventing light from one of said first and second illumination sources from reaching the portion of said information carrying member associated with the other of said first and second illumination sources.

17. The method according to claim 16 further comprising independently controlling the illumination of said first and said second illumination sources.

18. The method according to claim 13 wherein said translucent display panel has a diluted white appearance.

19. The method according to claim 12, comprising advancing the information carrying member along a direction from the first illumination source toward the second illumination source, whereby the second illumination source selectively illuminates said first portion of the information carrying member and said first illumination source selectively illuminates a third portion of said information carrying member.

20. A presentation aid for presenting information comprising:

a case having a translucent display panel defined therein, said translucent display panel having a front surface and a back surface;

a plurality of illumination sources disposed within said case, each of said illumination sources being positioned for illuminating a specific portion of the back surface of said translucent display panel;

baffle means disposed within said case to substantially prevent light from any one of said illumination sources from illuminating a portion of the back surface of said translucent display panel associated with others of said illumination sources;

a flexible sheet material for carrying presentation information thereon;

first and second roller means disposed within said case at opposing ends of said translucent display panel, said first and second roller means being adapted to receive said flexible sheet material means in a rollable fashion;

guide means for holding said flexible sheet material between said illumination sources and the back surface of said translucent display panel in close relation to the back surface of said translucent display panel; and control means for controlling said plurality of illumination sources.

21. The presentation aid according to claim 20 wherein said translucent display panel has a diluted white appearance.

22. The presentation aid according to claim 20 wherein said control means for controlling said plurality of illumination sources comprises a plurality of switches operative to control illumination by said illumination sources, any individual one of said plurality of switches associated with an individual one of said plurality of illumination sources.

23. The presentation aid according to claim 15, wherein the illumination sources are spaced apart in a direction from the first roller means toward the second roller means, and the baffle means comprises a plurality of walls, with each wall disposed between two illumination sources and extending transversely of said direction, whereby the baffle means divides the interior of the case into multiple compartments containing the illumination sources respectively, and rolling the flexible sheet material onto the first roller means from the second roller means results in a portion of the flexible sheet material passing through the compartments sequentially.

24. The presentation aid according to claim 15, wherein the case comprises two essentially identical shells each having a first end and an opposite second end, the first roller means is disposed within the first shell at the first end thereof, the first shell is hinged at its second end to the first end of the second shell, and the second roller means is disposed within the second shell at the second end thereof, and the translucent display panel comprises first and second sheets of translucent material at the front of the first and second shells respectively, whereby the case can be hinged between an open position, in which the two sheets are essentially coplanar and the hinge is between the first end of the first shell and the second end of the second shell, and a closed position, in which the sheets are confronting and the first end of the first shell is adjacent the second end of the second shell.

25. The presentation aid according to claim 17, wherein said switches are located outside the case.

26. A presentation aid for presenting information to an audience comprising:

a housing having a front and a back and also having first and second opposite ends;

a translucent display panel at the front of the housing, the translucent display panel having a front surface and a back surface and being oriented with the front surface toward the front of the housing and the back surface toward the back of the housing;

a first roller means disposed at the first end of the housing;

a second roller means disposed at the second end of the housing;

a flexible material sheet having a first end segment wound on the first roller means, a second end segment wound on the second roller means, and an intermediate segment extending between the first and second roller means adjacent the back surface of said translucent display panel, information being carried on said flexible material sheet;

a means for rotating at least one of the first and second roller means, whereby the flexible material sheet can be wound from the first roller means onto the second roller means;

a first illumination source for selectively illuminating a first portion of said intermediate segment of the flexible material sheet;

a second illumination source for selectively illuminating a second portion of said intermediate segment of the flexible material sheet, said second illumination source being spaced from the first illumination source in a direction from the first end of the housing toward the second end thereof; and a shielding means from preventing illumination from said first illumination source from reaching said second portion of said intermediate segment and for preventing illumination for said second illumination source from reaching said first portion of said intermediate segment, whereby information carried on one of said first and second portions can be viewed selectively from the front of the housing while not affecting viewing of information carried on the other of said first and second portions.

27. The presentation aid according to claim 26, comprising first and second switches connected to the first and second illumination sources respectively for controlling energization thereof independently of one another, said first and second switches being outside the housing.

* * * * *

UNITED STATES PATENT AND TRADEMARK OFFICE

CERTIFICATE OF CORRECTION

PATENT NO. : 5,347,735

DATED : September 20, 1994

INVENTOR(S) : Howard A. PRATT

It is certified that error appears in the above-indentified patent and that said Letters Patent is hereby corrected as shown below:

Col. 5,
Claim 1, line 10, the semicolon after "member" should be a comma.

Col. 7,
Claim 14, line 1, "claim 9" should read --claim 13--.

Claim 15, line 1, "claim 9" should read --claim 13--.

Col. 8,
Claim 19, line 1, "claim 12" should read --claim 16--.

Claim 23, line 1, "claim 15" should read --claim 20--.

Claim 24, line 1, "claim 15" should read --claim 20--.

Col. 9,
Claim 25, line 1, "claim 17" should read --claim 22--.

Signed and Sealed this

Twenty-ninth Day of November, 1994

*Attest:*

Bruce Lehman

BRUCE LEHMAN

*Attesting Officer*

*Commissioner of Patents and Trademarks*